US005184546A

United States Patent [19]

Ming-Sun

[11] Patent Number: 5,184,546

[45] Date of Patent: Feb. 9, 1993

[54] FULLY AUTOMATIC CURVED SURFACE PRINTING MACHINE

[76] Inventor: Liao Ming-Sun, No. 22, Alley 106, Lane 411, Sec. 1, Ney-Hwu Rd., Taipei, Taiwan

[21] Appl. No.: 832,333

[22] Filed: Feb. 7, 1992

[51] Int. Cl.[5] ..... B41F 17/20

[52] U.S. Cl. ..... 101/40.1; 101/124

[58] Field of Search ..... 101/40.1, 35, 124

[56] References Cited

U.S. PATENT DOCUMENTS 4,091,726 5/1978 Walker ..... 101/40.1

4,411,191 10/1983 Combeau ..... 101/40.1

*Primary Examiner*—Edgar S. Burr

*Assistant Examiner*—Stephen R. Funk

*Attorney, Agent, or Firm*—Bacon & Thomas

[57] ABSTRACT

This invention relates to a fully automatic curved-surface printing machine, which has a feeding mechanism, a screen block reciprocating mechanism, an elevation printing mechanism, a transmission system and a circulatory conveyor belt. The transmission system is the only means which provides the dynamic force to all the mechanisms. The feeding mechanism and the conveyor belt are set on the same conveying line. The feeding mechanism is designed to automatically push the curved-surface tube forward. The screen block reciprocating mechanism coordinates with an intermittent printing mechanism to enable the conveyor belt which moves intermittently to convey the curved-surface tube to the preset position. At this time the printing mechanism will push the curved-surface tube to the position ready for printing. The screen block reciprocating mechanism will activate the screen block to conduct its printing reciprocation. Upon completion of the printing process, the curved-surface tube will be conveyed by the conveyor belt for uniform collection, so as to further achieve the object and effect of a full automation.

3 Claims, 8 Drawing Sheets

FULLY AUTOMATIC CURVED SURFACE PRINTING MACHINE

FIELD OF THE INVENTION

The conventional machine which prints decorative designs and patterns onto articles with a curved surface is known as a curved-surface printing machine as indicated in FIG. 8. The said machine mainly comprises a horizontally moving screen block machine table 1*a*, a vertical elevation type of machine head 2*a*, and a curved-surface tube supporting frame 3*a*. The screen block machine table 1*a* is designed to function as an elevation, positioning and regulating mechanism. It conducts a horizontal reciprocation under the control of a gas pressure cylinder 4*a* which is set horizontally. A dye screen block is set on the screen block machine table 1*a*, so as to enable it to face the brush plate 21*a* which extends under the machine head 2*a* to conduct a printing process. The elasticity and position movement of the brush plate 21*a* located under the machine head 2*a* is mainly controlled by a cylinder which is vertically set, and which will make its timely elevation in accord with the horizontal reciprocation and position movement of the screen block machine table 1*a*. The mechanical motion of the conventional curved-surface printing machine which is formed by the various aforementioned mechanisms is performed by placing a curved-surface tube manually onto the supporting frame 3*a*. Then, the power supply is started to enable the screen block machine table 1*a* to move downward to a fixed position, so as to further allow the screen block to be in micro contact with the curved-surface tube. Then, the cylinder 4*a* will drive the screen block machine table 1*a* to conduct a horizontal positioning movement. At the same time, the screen block, which is in micro contact with the curved-surface tube, will rotate the curved-surface tube on the original position of the supporting frame 3*a*. The machine head 2*a* and the brush plate 21*a* which are descending at this time will scratch and brush the dye over the decorative design and pattern onto the curved-surface tube, and thus impress such decorative design and pattern thoroughly onto its periphery. Finally, the finished printed articles are collected by hand.

However, in the aforementioned curved-surface printing machine, manual labor is employed for the placing and removing of every curved-surface tube. Such a defect will not only reduce production capacity, but may also cause injury through the negligence of the workers. Therefore, it is not regarded as an ideal and practical design, in consideration of its working efficiency or production cost. In view of such defects, the inventor has made up his mind to devote himself to a continuous study and research, intending to make the printing process of said curved-surface printing machine to be operated in full automation and to achieve, at the same time, the multi-object of saving labor cost and increasing production capacity. At length, he managed to successfully complete the present invention which overcomes the defects which are found in the prior art.

SUMMARY OF THE INVENTION

The main object of this invention is to provide a fully automatic curved-surface printing machine having an automatic and integrally processed concept of design. The said machine comprises a feeding mechanism, a screen block reciprocating mechanism, an elevation printing mechanism, a transmission system and a circulatory conveyor belt. Wherein, a coordination made by the feeding mechanism with the intermittent motion of the circulatory type of conveyor belt will enable the conveying of the curved-surface tube to be automatically operated. Operating in coordination with the mechanical motion of the elevation printing mechanism, the screen block reciprocating mechanism will, at the time when the curved-surface tube is being conveyed by the conveyor belt for position fixing, conduct a fully automatic curved-surface printing process. After completing a color printing process, the curved-surface tube will be conveyed by the conveyor belt for a collection all at the same time, and thus complete its integral process. The dynamic force which activates the coupling of the various precedingly mentioned mechanisms is mainly supplied by a transmission mechanism. It enables the coordination between the conveying process and color printing and further achieves the practical effect of raising its production capacity and working efficiency under an integral printing process, to the ultimate effect of improving the defects found in a conventional curved-surface printing machine and upgrading its level of operation.

A DETAILED DESCRIPTION OF THIS INVENTION

Figure 1:
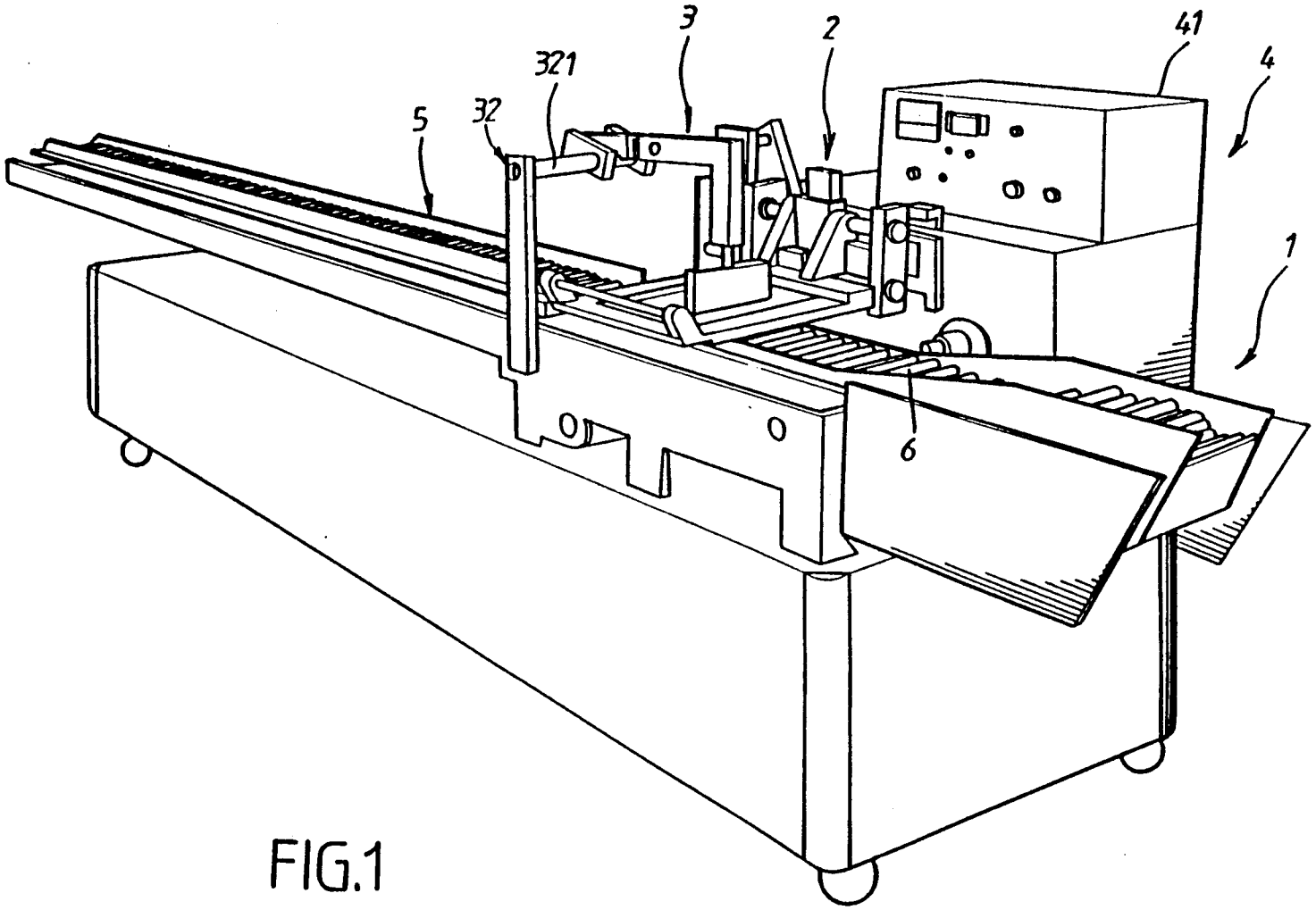
FIG. 1 is a perspective view of the printing machine of this invention.

Please refer to FIG. 1, from which it can be seen that the fully automatic curved-surface printing machine provided by this invention mainly comprises a feeding mechanism 1, a screen block reciprocating mechanism, 2, an elevation printing mechanism 3, a transmission system 4 and a circulatory conveyor belt 5. The conveying line jointly formed by the feeding mechanism 1 and the circulatory conveyor belt 5 is an integral processing production line for the curved-surface tube 6. The transmission system 4 which supplies a dynamic force to the various precedingly mentioned mechanisms is set in a control box 41 at the rear of the production line. By means of a fully automatic and integrally processed concept of design, this invention enables the curved-surface tube 6 to achieve the effects of feeding according to the right order, printing and conveying automatically. Besides entirely avoiding manual labor, it can also effectively upgrade production capacity and working efficiency. It is, therefore, regarded as an invention which is remarkably noted for its novelty, practicality and patentability.

Please refer to FIGS. 1. and 2. From these illustrations, it can be seen that the aforementioned transmission system 4 is presented in a plane layout when it is viewed from the reverse side. It comprises a motor 42 which generates a dynamic force, a drive gear 43, a geneva gear mechanism 44, a transmission gear 45, a driven gear 46 and a cam gear unit 47, with a chain 48 fixed therein for coupling these elements. The geneva gear 44 comprises an octant wheel 441 and turning wheel 442. When being turned, the arc-shaped gear surface of said octant wheel 441 will be connected with the main shaft 443 of the turning wheel 442. When the turning wheel 442 is turned a fixed circumferential distance, it will turn the gear groove of the said octant wheel 441 with a turning rod 444 to enable the octant wheel 441 to conduct intermittent revolution. The cam gear unit 47 is jointly formed by a cam 471 and a gear 472 which are set on the front and the rear direction of the same shaft. The surface of the cam 471 is connected with a rolling wheel which is located at the bottom of an elastic floating rod 31. By following the revolving of the said cam 471, the floating rod 31 will be caused to move, so as to control the elevation and positioning of the elevation printing mechanism 3 in a synchronized manner. In addition, the transmission gear 45 in the transmission system 4 is used to activate the horizontal reciprocation and positioning of the screen block reciprocating mechanism 2. The driven gear 46 is an idle transmission gear without any substantial driving function.

Figure 2:
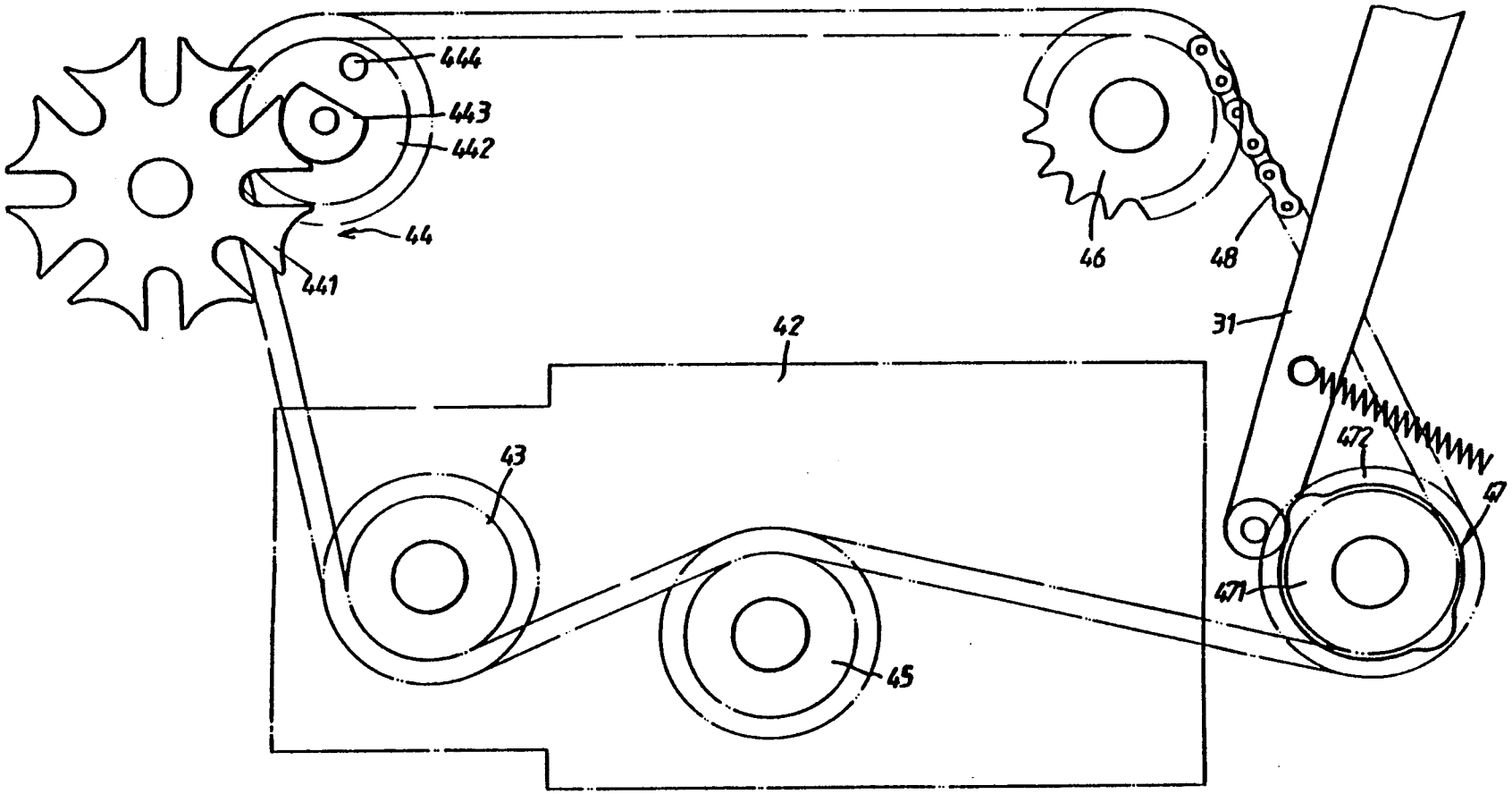
FIG. 2 is a schematic drawing of the transmission system of this invention.
Figure 3:
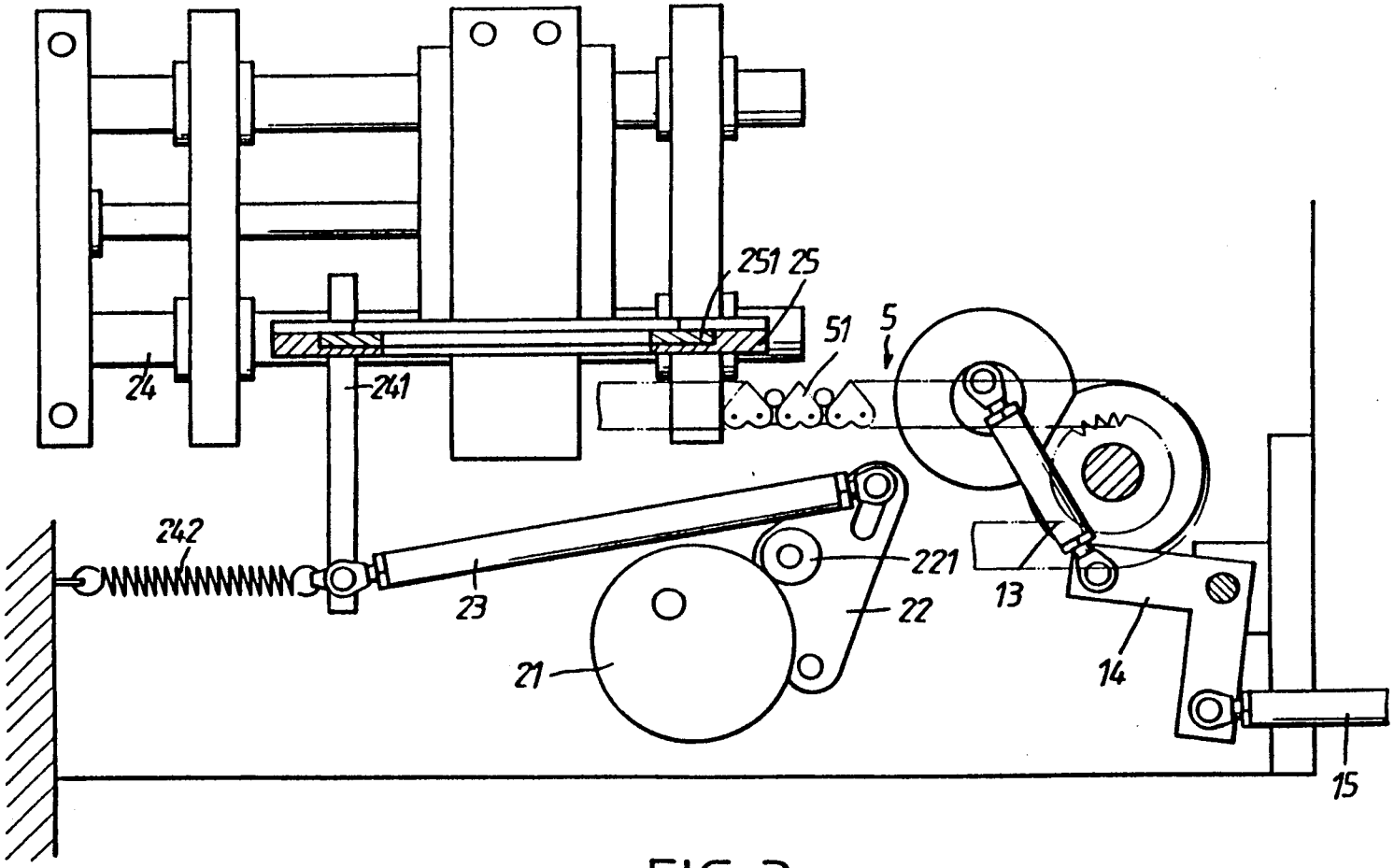
FIG. 3 illustrates the structure of the screen block reciprocating mechanism and the circulatory conveyor belt of this invention.

Please refer to FIGS. 2 and 3, which illustrate the transmission system of the screen block reciprocating mechanism 2 and the circulatory conveyor belt 5 presented in this invention. As previously mentioned, the transmission gear 45 in the transmission system 4 is mainly used to drive the screen block reciprocating mechanism 2. The main shaft of said transmission gear 45 which extends to the exterior of the control box 41 is connected with an eccentric wheel 21, the wheel surface of which contacts the rolling wheel 221 of a triangular block 22. One end of the triangular block 22 is connected with one end of a connecting rod 23, while the other end of the connecting rod 23 is pivotally connected with an extension rod 241 located under a twin-rod type of reciprocating seat 24. At the exterior of the spot to which the said extension rod 241 is connected, a spring 242 is fixed to a machine table. This enables the reciprocating seat 24 to have an elastic position recovering function, so as to activate the horizontal reciprocation and positioning of the reciprocating seat 24, when the connecting rod 23 is moved in a straight line motion as a result of the rotation made by the surface of the eccentric wheel 21. A screen block frame 25 which can be lifted outwardly is also pivotally set in an upper direction of the reciprocating seat 24, and a screen block 251, where a decorative design pattern can be prefixed, is set in a central portion of said screen block frame 25 for printing.

As for the geneva gear 44 in the transmission system 4, its octant wheel 441 and the main shaft of the turning wheel 442 extend out of the control box 41. The main shaft of turning wheel 442 is used to operate a feeding mechanism 1 (which will be described in detail below). The main shaft of octant wheel 441 is mainly used to move the circulatory conveyor belt 5 at the two lateral sides of the machine table, and to enable it to produce an intermittently circulatory motion. The two conveyor belts 5 are made in a chain shape, onto their surface chain teeth 51 are welded to enable the curved-surface tube to be conveniently conveyed therealong. The intermittent time produced by the conveyor belt 5 can exactly match the reciprocating cycle of the reciprocating seat 24 to enable the printing process to be interlocked with the conveying cycle.

Figure 4:
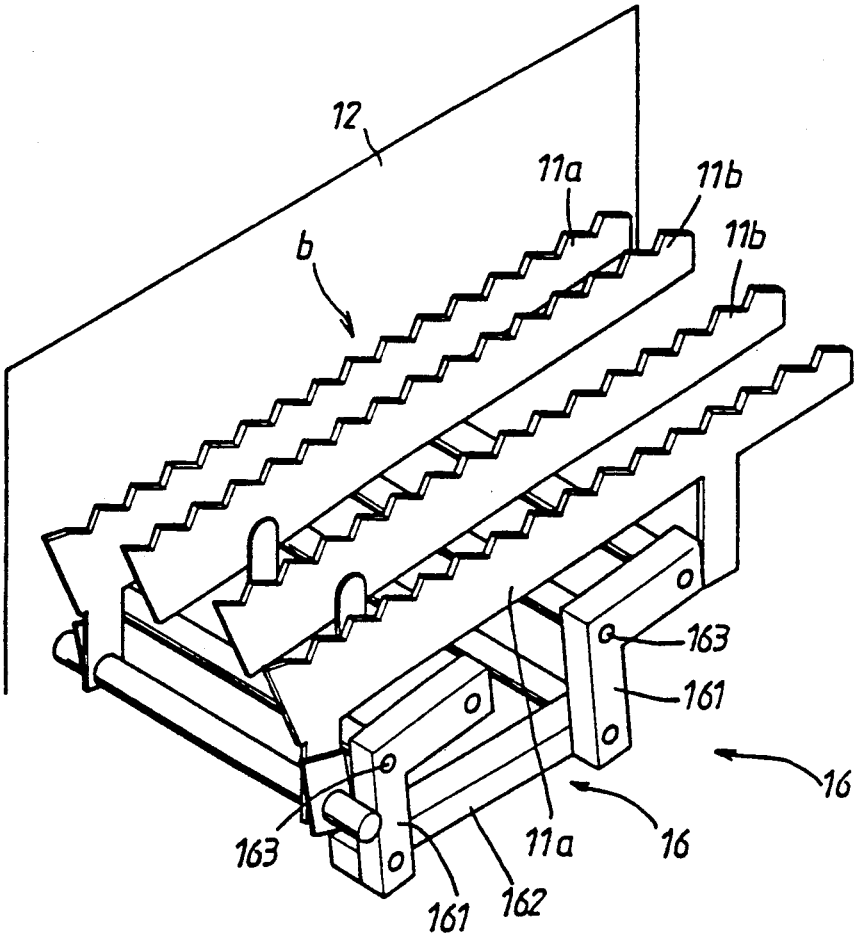
FIG. 4 is a schematic view of the feeding mechanism of this invention.
Figure 5:
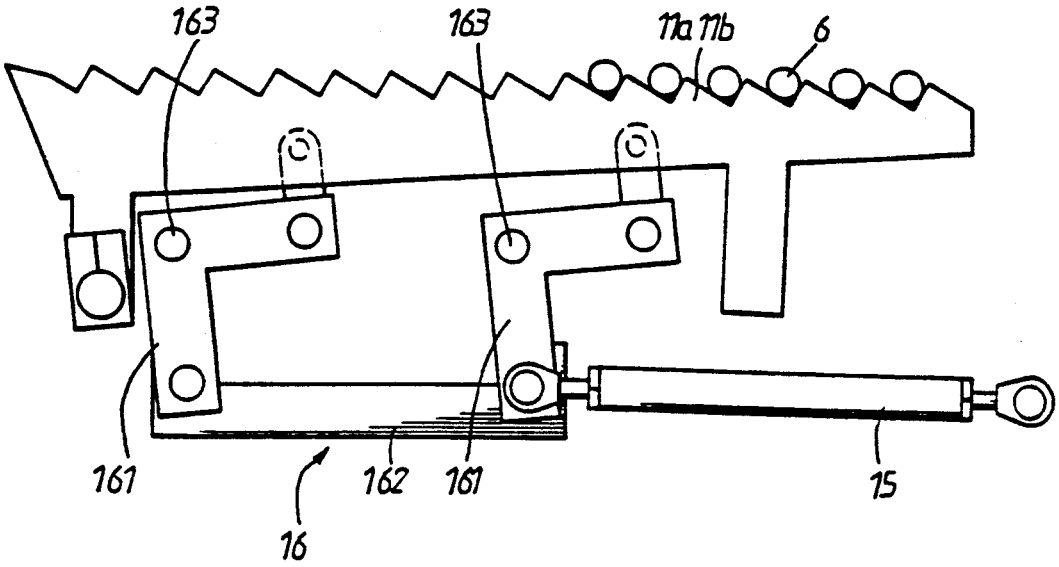
FIG. 5 is a side view showing a first position of the feeding mechanism of this invention.
Figure 6:
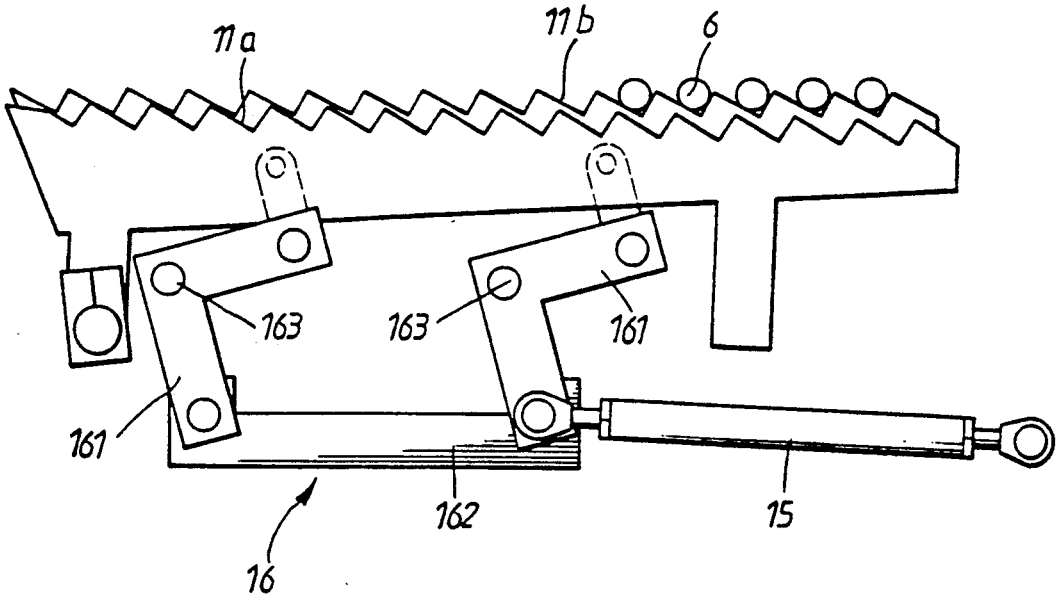
FIG. 6 is a side view showing a second position of the feeding mechanism of this invention.

Please refer to FIG. 4 through FIG. 6, which illustrate the structural design of the feeding mechanism 1 of this invention. The said feeding mechanism 1 is a tub shaped body set in the front of the conveying direction of the conveyor belt 5 and comprises mainly four tooth face plates 11 and protective plates 12 which are set at its two lateral sides. The two lateral tooth face plates **11*a* of the said four tooth face plates 11 are arranged in a fixed condition. The other two tooth face plates 11*b* in a central portion are mounted in a moving condition. The tooth faces of said two units of tooth face plate 11*a* and 11*b* are separately interlocked in a two-by-two style, which is designed with the practical function of pushing the curved-surface tube 6 forward when the tooth face plate 11*b* is moving. Please refer to FIG. 3, which provides an illustration of the floating conveying structure of said tooth face plates 11*b*. Its design mainly lies in pivotally attaching a connecting rod 13 eccentrically onto the outwardly extended main shaft of the turning wheel 442. While the other end of said connecting rod 13 is pivotally connected with one end of a vertical block 14, which is pivotally connected. A connecting rod 15 which extends to the feeding mechanism 1, is also pivotally set to block 14 other end, to enable the said connecting rod 13 to drive the vertical block 14 when the eccentric shaft is revolving. As a result of the movement of the vertical block 14, the oblique straight line motion of the connecting rod 13 will be converted into horizontal straight line motion of connecting rod 15. Moreover, the other end of connecting rod 15 is pivotally attached to the seat 16 of the aforementioned floating tooth face plates 11*b*. The said seat 16 comprises two vertical blocks 161, one in the front the other at the rear, connected together with horizontal rod 162, each with a pivot point 163. Therefore, when connecting rod 15 is conducting a horizontal straight line motion, it will activate the said pivoting seat 16 to pivot with branch point 163 as its center, and it will further drive the said floating tooth face plate 11*b* to keep an upward/downward floating movement (as shown in FIGS. 5 and 6). Owing to the interlocking design of the tooth faces of said tooth face plates 11*b* and the fixed tooth face plates 11*a*, when the curved-surface tubes 6 are placed in a disorderly fashion in the feeding mechanism 1, besides pushing the curved-surface tube 6 forward, it will also be arrange the scattered curved-surface tubes 6 into proper order. This will enable the curved-surface tubes to be conveyed according to a proper order to the conveyor belt 5. The floating of the tooth face plates 11*b* is also designed to coordinate with the intermittent position moving of the conveyor belt 5**, so as to feed the material intermittently.

Figure 7:
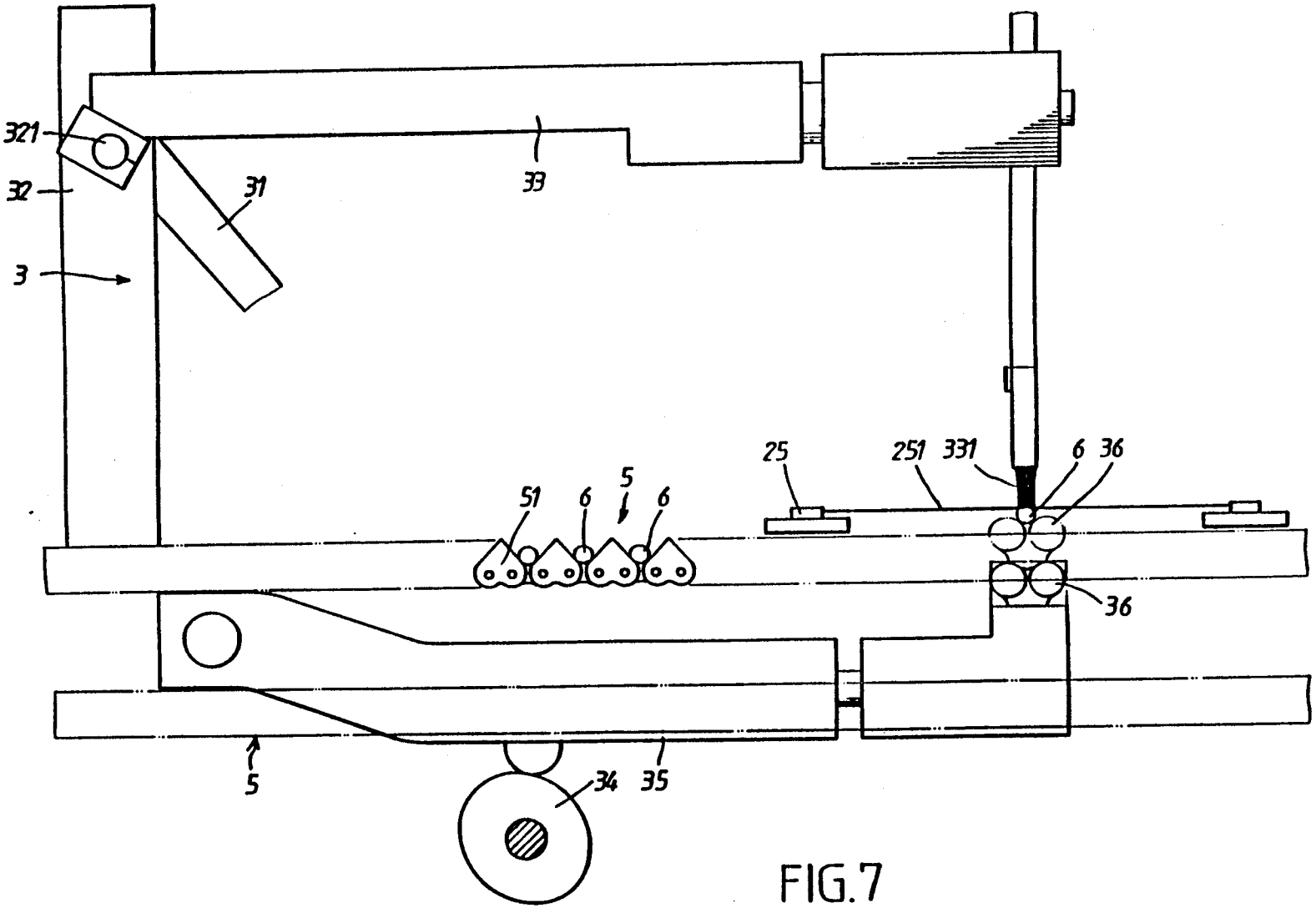
FIG. 7 is a side elevational view of the printing mechanism of this invention.
Figure 8:
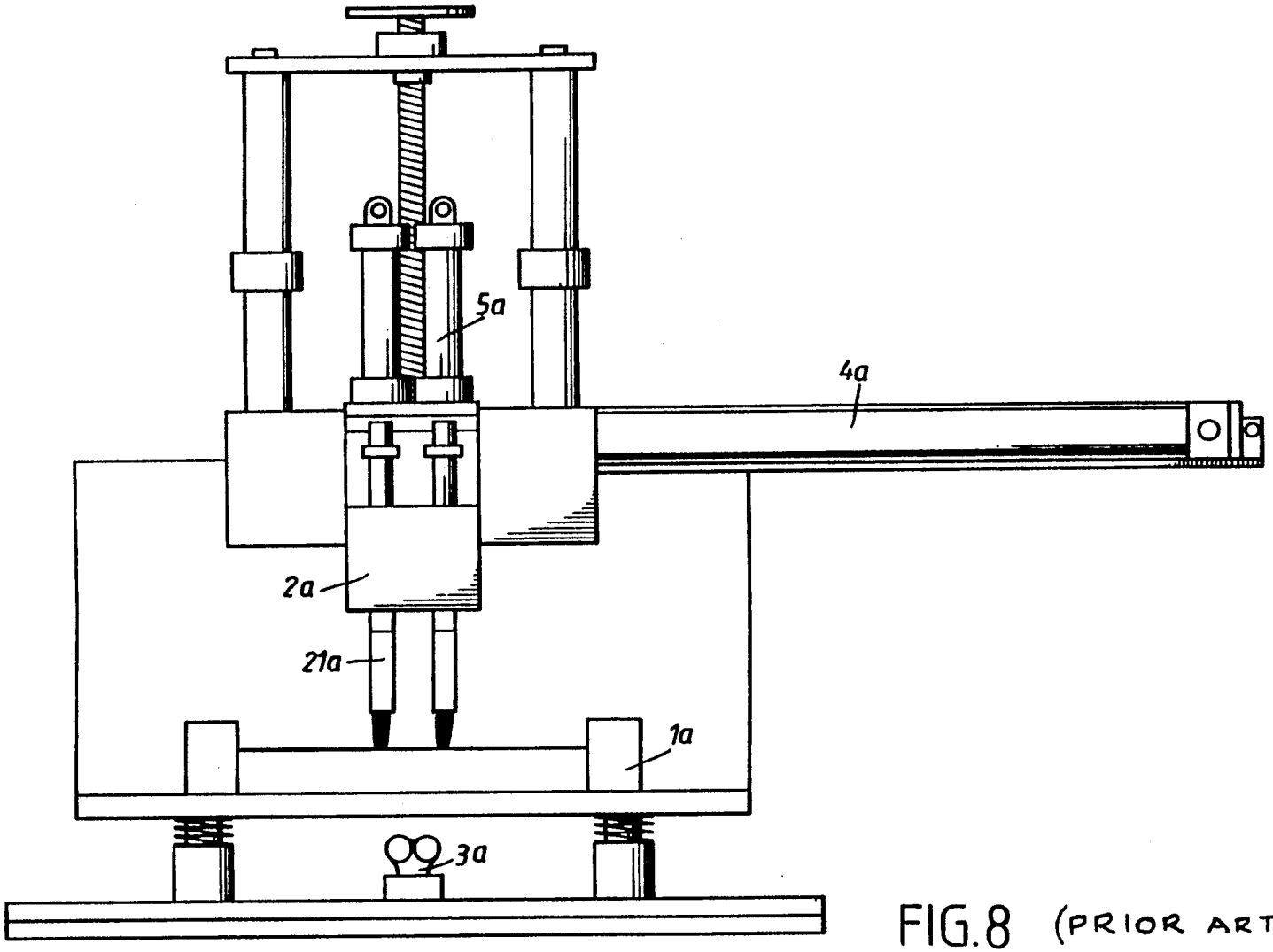
FIG.8 (PRIOR ART)
FIG. 8 is a front view of a known type of printing machine.

FIGS. 1, 2 and 7 illustrate the structure of the elevation orienting mechanism 3, from which it can be seen that the function of its transmission system 4 is mainly performed by the cam gear unit 47 as previously mentioned. The floating rod 31 which is moved by the cam 471 of said cam gear unit 47 extends out of the control box 41 and is fixed to a horizontal shaft 321 which is attached to a hanging frame 32 on the conveyor belt 5. The said horizontal shaft 321 can pivot. A printing brush rod 33 which can be extended horizontally is set in the central portion of said horizontal shaft 321. A brush plate 331 is extended downward from said printing brush rod 33 to further reach and squeeze against the surface of the screen block 251 on the screen block frame. Following the floating and moving of the floating rod 31, it will enable the horizontal shaft 321 to produce a motion, so as to further drive the printing brush rod 33 to elevate and conduct a printing process. In the lower direction of the machine table, two cams 34 (as a lateral view is indicated, only one of them can be shown) are set on the main shaft of the cam gear unit 47 in the transmission system 4 which extends outwardly on the main shaft rod of the control box 41. The two cams 34 separately push upward against two hanging arms 35 to enable said hanging arms 35, which are pivotally attached at one end, to produce an upward and downward pivoting and positioning movement. On the other end of said hanging arm 35, a curve-surfaced tube seat 36 is protrusively set. At the same time of the elevation of said hanging arms 35, the concave spot in the central part of said curved-surface tube seat 36 will raise the curve-surfaced tube 6, and squeeze it protrusively against the bottom side of the screen block 251 of the screen block frame 25. Then, it will further connect with the brush plate 331 which has moved downward. At the time of the reciprocating positioning of the screen block 251, the force of friction produced by the screen block 251 will enable the said curved-surface tube 6 to revolve. At the same time, the brushing plate 331 will then brush and print the decorative design and pattern which are impressed on the screen block 251 onto the said curved-surface tube 6, and thus complete a curved-surface printing process. Similarly, the elevation of said brushing rod 33 and the hanging arm 35 should match with the reciprocating positioning of the conveyor belt 5. After printing is completed, the curved-surface tube 6 will be automatically pushed forward by the conveyor belt 5.

A description of the operation procedures of this invention which is formed by the various above-mentioned mechanisms is set hereunder in coordination with the illustrations shown in the related drawings. Firstly, place the curved-surface tube 6 onto the feeding mechanism 1. Through the regulating caused by the floating of the tooth face plates 11, the curved-surface tube 6 will be pushed forward according to the right order to the conveyor belt 5. When the curved-surface tube 6 is being pushed forward to the bottom side of the screen block 251, the brushing rod 33 of the elevating printing mechanism 3 and the curved-surface tube seat 36 will, as a result of the intermittent position-moving of the conveyor belt, squeeze the curved-surface tube 6 against the bottom side of the screen block 251. The reciprocating position movement of the screen block reciprocating mechanism 2 will drive the curved-surface tube 6 for position fixing and revolving. It will, under the brushing and printing of the brushing plate 331, brush and print the decorative design and pattern which are impressed beforehand on the screen block 251 onto the surface of the curved-surface tube. Because of the downward movement of the hanging arms 35, the curved-surface tube 6, which has completed printing, will resume its position on the conveyor belt 5. It will then be moved to the extreme end of the processing line under the conveying of the conveyor belt 5 for collection all at the same time, and thus complete the integral and automatic processing presented by this invention, to the ultimate effect of achieving the objects of raising production capacity and shortening working hours.

Summarizing the above description, it can be seen that with its unique structural assembly, the fully automatic curved-surface printing machine presented by this invention indeed helps improve the defects of low production efficiency and the lack of safety found in a conventional curved-surface printing machine. It is, therefore, regarded as an invention which is remarkably noted for its novelty, practicality and patentability. For those who are familiar with the prior art, however, any of the changes and modification of or derived from the preferred embodiments of this invention shall not be regarded as deviating from the scope and spirit of this invention.

I claim:

1. A fully automatic curved-surface printing machine which has a feeding mechanism, a screen block reciprocating mechanism, an elevation printing mechanism, a transmission system and a circulatory conveyor belt, in which the feeding mechanism and the conveyor belt jointly form a processing line, while the transmission system is set inside a control box which is located at a lateral side of the processing line comprising:

a) the transmission system, which comprises: a motor which provides a dynamic force; a main drive gear on a main shaft driven by the motor; a geneva gear mechanism; a transmission gear; a driven gear; a cam gear unit; and a chain drivingly connecting these elements; wherein the geneva gear mechanism also comprises an octant wheel and a turning wheel such that upon the revolving of the turning wheel the said octant wheel moves in an intermittent revolving fashion, and wherein the cam gear unit comprises a cam and a gear which are set on the same shaft with one in a front and the other at a rear, having a wheel surface on the cam; the transmission system further comprising a rolling wheel at one end of a movable rod in contact with the wheel surface to enable the rod to move in accord with the cam, so as to control in a synchronized manner a elevating position movement of the elevation printing mechanism;

b) the screen block reciprocating mechanism and the circulatory conveyor belt, driven by the main shaft of said transmission system comprising an eccentric wheel driven by the main shaft and having a, wheel surface; a pivoting triangular block having a rolling wheel bearing against the wheel surface, a first connecting rod having one end pivotally connected to the triangular block, while the other end of the first connecting rod is pivotally connected with a downwardly extending rod of a reciprocating seat; a spring extending between the downwardly extending rod and a machine table, such that when the eccentric wheel rotates it will drive the reciprocating seat; a screen block frame having a screen block pivotally attached to said reciprocating seat; a transmitting rod operatively connecting the octant wheel with the circulatory conveyor so as to produce an intermittent circulatory motion;

c) the feeding mechanism is formed in a tub shape at a front position of a conveying direction of the circulatory conveyor belt, and comprises four tooth face plates of which the tooth face plates at two lateral sides are fixed, while the other two tooth face plates in its central section are movable, the tooth faces of said tooth face plates are set in a two-by-two interlocking manner, the movable tooth face plates moved by a second connecting rod having one end eccentrically attached to a main shaft in the geneva gear unit which extends out of the turning wheel, while another end of said second connecting rod is pivotally connected with a pivoting vertical block, which is also pivotally connected to a third connecting rod which is operatively connected to the feeding mechanism such that pivoting motion of the vertical block caused by motion of the second connecting rod is converted into the third connecting rod's horizontal straight line motion which further drives the movable tooth face plates; and, d) the elevation printing mechanism comprising a second transmission system is formed by several cam gear units bearing against a pivoting rod which is driven by the cam of said cam gear unit; a horizontal shaft which is attached to a hanging frame of the circulatory conveyor, the said horizontal shaft also being able to revolve in a central part of said horizontal shaft, a printing brush rod is mounted having a horizontally extended brush plate which can exactly extend to squeeze against a screen block surface of the screen block frame; wherein the second transmission system has two cams, which separately push upward against two hanging arms, so that the hanging arms which are pivotally attached at one end will conduct an upward and downward positioning, while the other end of said hanging arms have a curved-surface tube seat protrusively attached thereto extending in an upward direction such that, at the same time of the elevation of the hanging arm, a concave part of the curved-surface tube seat will raise a curved-surface tube and squeeze it upwardly against a bottom side of the screen block in the screen block frame, and will then be further connected with the brush plate which has moved downward.

2. The fully automatic curved-surface printing machine as described in claim 1, in which the circulatory conveyor belt driven by the geneva gear unit has a surface of which symmetrical plum-shaped teeth are welded.

3. The fully automatic curved-surface printing machine as described in claim 1, in which the feeding mechanism comprises two vertical pivoting blocks, with one being attached in a front and the other at a rear of the feeding mechanism; and horizontal rods connecting the two vertical blocks such that when the horizontal rods move in a horizontal straight line motion, it will cause the pivoting vertical blocks to pivot.

* * * * *